US006752524B2

(12) United States Patent
Becker et al.

(10) Patent No.: US 6,752,524 B2
(45) Date of Patent: Jun. 22, 2004

(54) HIGH-PRESSURE DISCHARGE LAMP FOR MOTOR VEHICLE HEADLIGHTS

(75) Inventors: Juergen Becker, Berlin (DE); Wolf-Ruediger Becker, Honow (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 63 days.

(21) Appl. No.: 09/988,590

(22) Filed: Nov. 20, 2001

(65) Prior Publication Data

US 2002/0060912 A1 May 23, 2002

(30) Foreign Application Priority Data

Nov. 21, 2000 (DE) ..... 100 57 823

(51) Int. Cl.[7] ..... F21V 19/00
(52) U.S. Cl. ..... 362/548; 362/226; 362/539
(58) Field of Search ..... 362/226, 548, 362/549, 519, 457, 263, 539; 313/318.13, 318.01, 318.08, 318.09

(56) References Cited

U.S. PATENT DOCUMENTS 4,747,029 A * 5/1988 Liverance et al. ..... 362/226
4,855,876 A * 8/1989 Kudo ..... 362/457
5,313,135 A * 5/1994 Fletcher ..... 313/318.01
6,031,323 A * 2/2000 Behr et al. ..... 313/318.01

FOREIGN PATENT DOCUMENTS

EP 0 786 791 1/1997

* cited by examiner

*Primary Examiner*—Sandra O'Shea
*Assistant Examiner*—Bao Q. Truong
(74) *Attorney, Agent, or Firm*—William E. Meyer

(57) ABSTRACT

The invention relates to a high-pressure discharge lamp for motor vehicle headlights which is provided with an annular flange (127) for mounting the high-pressure discharge lamp in the lamp holder of the motor vehicle headlight. According to the invention, the annular flange (127) is fixed on the base (125) by means of a snap or latching connection and is adapted to the lamp holder of motor vehicle headlights for halogen incandescent lamps. As a result, the high-pressure discharge lamp according to the invention can be inserted in motor vehicle headlights for halogen incandescent lamps.

5 Claims, 3 Drawing Sheets

HIGH-PRESSURE DISCHARGE LAMP FOR MOTOR VEHICLE HEADLIGHTS

The invention relates to a high pressure discharge lamp for motor vehicle headlights.

BACKGROUND OF THE INVENTION

A high-pressure discharge lamp for a motor vehicle headlight is disclosed, for example, in European Laid-open Specification EP-A 0 786 791. The high-pressure discharge lamp described in this document has a discharge vessel in which there are arranged electrodes for generating a light-emitting gas discharge, an outer bulb surrounding the discharge vessel, and a plastic base which is provided with the electric terminals of the high-pressure discharge lamp and in which the lamp vessels are fixed. The base is provided with a flange which serves to mount the high-pressure discharge lamp in a motor vehicle headlight for high-pressure discharge lamps. The mounting position of a headlight lamp is usually defined by mutually coordinated positioning means on the annular flange and on the lamp holder of the motor vehicle headlight This purpose is usually served by three asymmetrically constructed reference noses integrally formed on the annular flange, which extend radially outwards and engage in corresponding cutouts in the lamp holder of the motor vehicle headlight. In addition, the reference noses also serve as coding means for the type of lamp. Thus, in the case of commercially available headlight lamps such as, for example, H4 or H7 halogen incandescent lamps, the annular flange is constructed differently in a corresponding fashion in order to exclude confusion when the lamp is changed.

BRIEF SUMMARY OF THE INVENTION

It is the object of the invention to use the simplest possible means to retrofit high-pressure discharge lamps which are intended for mounting in motor vehicle headlights specifically designed for them, in such a way that they can be mounted in motor vehicle headlights for halogen incandescent lamps.

The high-pressure discharge lamp according to the invention is provided for use in a motor vehicle headlight, and has at least one transparent lamp vessel and means for generating a light-emitting gas discharge as well as a base which is provided with electric terminals and in which the at least one transparent lamp vessel is fixed The base is provided with an annular flange for the purpose of mounting the high-pressure discharge lamp in the holder of a motor vehicle headlight, the annular flange being adapted according to the invention to the holders of motor vehicle headlights for halogen incandescent lamps, and being fastened on the base by means of a snap or latching connection.

High-pressure discharge lamps can be retrofitted in a simple way by means of the above-named measures such that they can also be mounted in motor vehicle headlights for halogen incandescent lamps. For example, the annular flange is coordinated with the holder of the motor vehicle headlight for an H7 lamp or an H4 lamp. In this case, the high-pressure discharge lamp according to the invention can be operated as a motor vehicle headlight lamp instead of an H7 lamp or an H4 lamp in the H7 lamp holder or H4 lamp holder of the motor vehicle headlight. According to the invention, the annular flange is fixed on the base of the high-pressure discharge lamp by means of a snap or latching connection. Surprisingly, it has been proved that the snap or latching connection between the base and the annular flange ensures a reliable fastening of the flange on the base and, moreover, also ensures adjustment of the luminous means in the headlight reflector. There is consequently no need for any complicated changes on the base in order to retrofit the high-pressure discharge lamp. Moreover, the same tools can be used to produce the annular flange as are used to fabricate the corresponding halogen incandescent lamp.

The above named snap or latching connection is advantageously formed by a groove arranged in the base and a plurality of lugs which are arranged on the annular flange and are provided for engaging in the groove. The groove is preferably arranged in the outer wall of the base, and can therefore also still be provided subsequently by milling in the case of already fabricated high-pressure discharge lamps. The lugs arranged on the annular flange have a spring action and therefore ensure in a simple way that the annular flange can be snapped or latched into the groove in the base. The lugs are preferably arranged in an annular manner and extend radially inward, and the free ends of the lugs define the diameter of the annular opening or the inside diameter of the annular flange. In order to be able to establish the mounting position of the high-pressure discharge lamp uniquely, the base and the flange advantageously have means which are coordinated with one another and prevent rotary movements of the annular flange with reference to the base. It is preferred for this purpose to provide one of the lugs of the annular flange with a cutout in which a web arranged in the groove engages.

The base of the high-pressure discharge lamp according to the invention advantageously consists of an electrically insulating material, preferably of a plastic, in order to ensure an adequate high voltage strength The annular flange advantageously consists of a metal, preferably of a stainless steel or of German silver. As a result, the annular flange has a high mechanical stability. Moreover, as already mentioned above, in this case the same tools can be used to manufacture the annular flange as are used to fabricate halogen incandescent lamps.

Metal fastening means anchored in the base are provided for holding and/or adjusting the at least one lamp vessel in the base. In the region of these fastening means, the annular flange advantageously has cutouts which extend the annular opening of the flange, in order to avoid electric flashovers, corona discharges or leakage currents between the fastening means and the annular flange.

In the high-pressure discharge lamp according to the invention, the annular opening of the annular flange is advantageously arranged relative to the positioning means of the annular flange, which determine the mounting position of the high-pressure discharge lamp in the headlight, in such a way that after the mounting of the high-pressure discharge lamp in the motor vehicle headlight the longitudinal axis of the at least one lamp vessel is displaced in a fashion parallel to the optical axis of the headlight reflector. The convection-induced curvature of the light-emitting discharge arc in the case of its optical imaging in the reflector is taken into account by means of this measure.

If the high-pressure discharge lamp according to the invention is used as a substitute for an H4 lamp in an appropriate motor vehicle headlight, the high-pressure discharge lamp according to the invention is advantageously provided with a means for shielding light, in order to generate the light distribution corresponding to the passing beam. The means for shielding light is preferably constructed as a metal sheet partially surrounding the at least one lamp vessel. For reasons of fabrication, the metal sheet is preferably fastened on the annular flange or constructed in one piece with the annular flange. In the latter case, the annular flange and the metal sheet can be produced jointly in a single deep-drawing process.

BRIEF DESCRIPTION OF THE SEVERAL VIEWS OF THE DRAWINGS

The invention is explained in more detail below with the aid of a plurality of preferred exemplary embodiments. In the drawing.

DETAILED DESCRIPTION OF THE INVENTION

Figure 1:
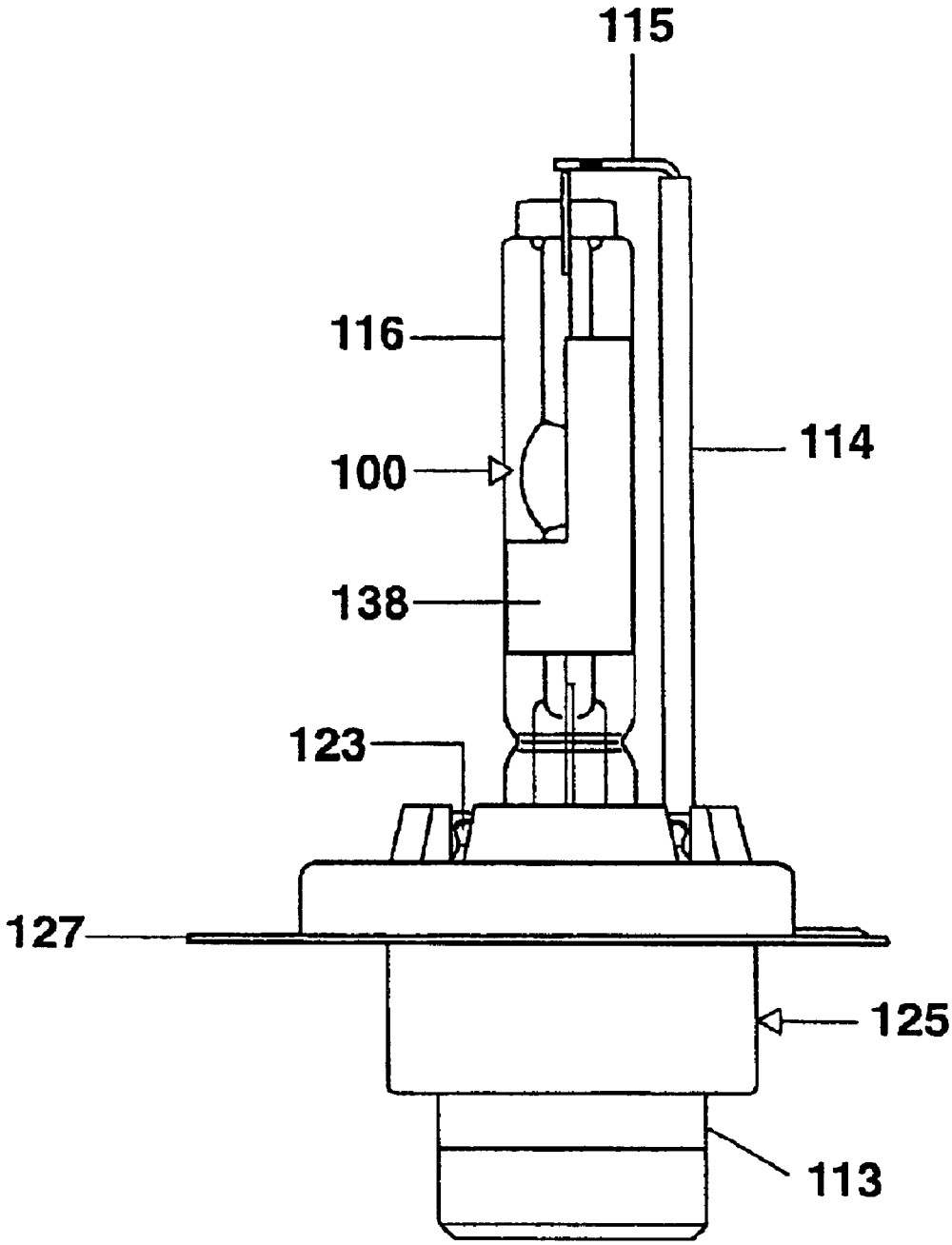
FIG. 1 shows a side view of a first exemplary embodiment of the high-pressure discharge lamp according to the invention.
Figure 2:
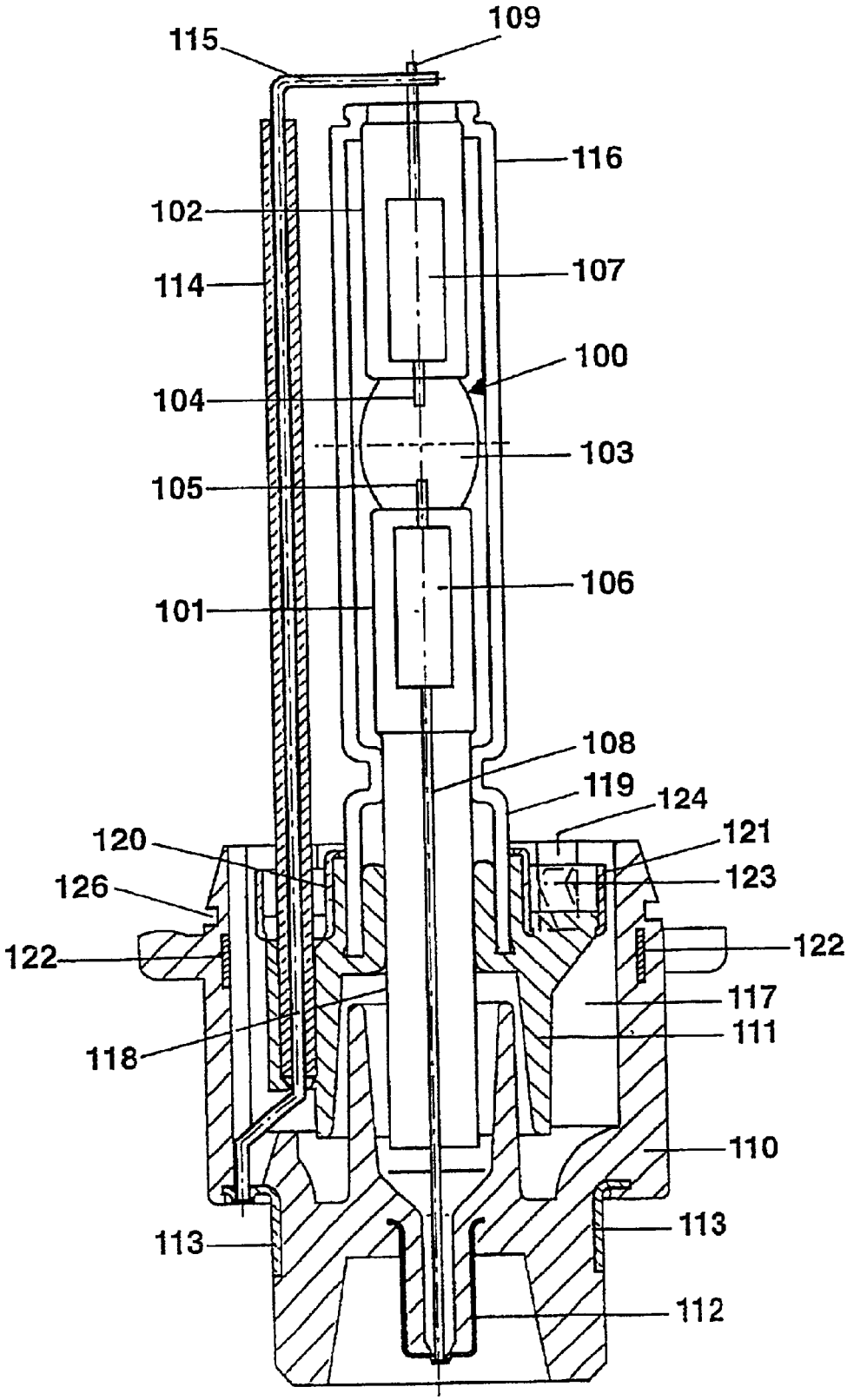
FIG. 2 shows a cross section through the high-pressure discharge lamp illustrated in FIG. 1, without annular flange.
Figure 3:
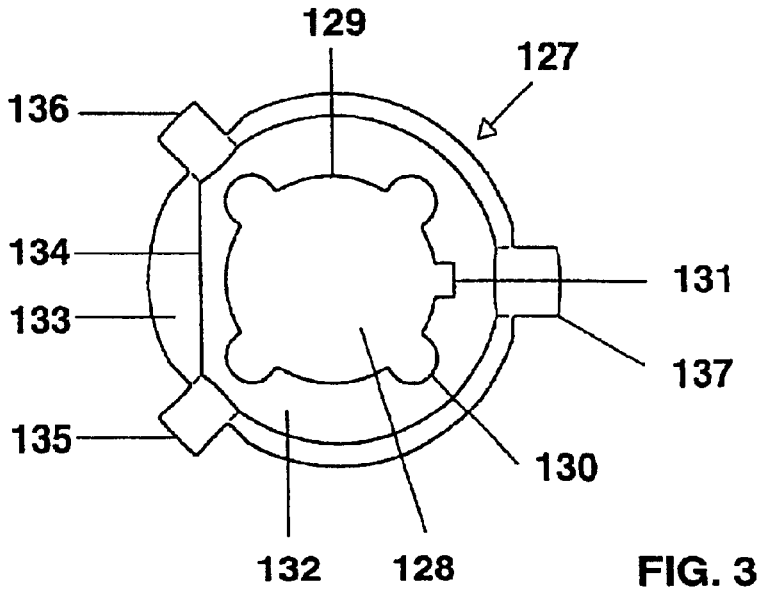
FIG. 3 shows a plan view of the annular flange of the high-pressure discharge lamp illustrated in FIG. 1.

FIGS. 1 to 3, which are substantially true to scale, show a high-pressure discharge lamp in accordance with the first exemplary embodiment of the invention, which is provided for operation in the horizontal position, that is to say with a horizontally arranged discharge arc, in a motor vehicle headlight This exemplary embodiment is a high-pressure discharge lamp with a base on one end and having electric power consumption of approximately 35W.

The high-pressure discharge lamp has a tubular discharge vessel 100 with a discharge space 103 sealed in a gastight fashion, and a pinched end 101 near the base and a pinched end 102 remote from the base. Projecting into the discharge space 103 are two electrodes 104, 105 which are connected in an electrically conducting fashion, in each case via a molybdenum foil 106, 107 sealed in a gastight fashion in the pinched end 101 or 102, respectively, to a supply lead 108 and 109 led out of the pinched end 101, 102, and serve the purpose of generating a light-emitting gas discharge. The discharge vessel 100 is surrounded by a cylindrical outer bulb 116, which is arranged virtually coaxially with the discharge vessel 100 and is sealed onto the pinched end 102 remote from the base and onto a tubular extension 118 of the discharge vessel 100. The outer bulb 116 is fitted with a tubular elongation 119 which surrounds the tubular extension 118 of the discharge vessel 100. The lamp vessels 100, 116 are fastened in the base 125, which consists of plastic, by means of the tubular elongation 119 and the tubular extension 118. Fixed on the outer wall of the base 125 is an annular flange 127, which consists of stainless steel or German silver and serves to mount the high-pressure discharge lamp in a motor vehicle headlight.

Details of the base 125 can be gathered from FIG. 2. The base 125 has a pot-type base shell 110, consisting of an injection-molded plastic part, and an adjustable base inner part 111, which is arranged inside the base shell 110 and likewise consists of an injection-molded plastic part. In order to provide a base for the high-pressure discharge lamp, the tubular elongation 119 of the outer bulb 116 is sealed in a holding device, constructed as a depression, of the base inner part 111 by inductive heating of a metal sleeve 120, which is integrated in the base inner part 111 and surrounds the tubular elongation 119 of the outer bulb 116. The base inner part 111 is arranged completely in the interior 117 of the base shell 110. The outer wall of the base inner part 111 is formed partially from an annular metal part 121, which surrounds the base inner part 111 and is anchored in the base inner part 111. Embedded in the side wall of the pot-type base shell 110 is a metal ring 122 which has four integrally formed welding lugs 123. These four welding lugs 123 project into the interior 117 of the base shell 110 and, upon insertion of the base inner part 111 in the base shell 110 and during the subsequent adjustment of the lamp, bear resiliently against the annular metal part 121 of the base inner part 111. Upon termination of the adjustment, the welding lugs 123 are welded to the annular metal part 121 and, as a result, the base inner part 111 and the base shell 110 are connected to one another in the adjusted position. In each case, the base shell wall 110 has a cutout 124 in the region of the welding lugs 123 in order for the welding lugs 123 to be accessible for the welding tools.

The base shell 110 is provided with two electric contacts 112, 113 for supplying power to the high-pressure discharge lamp. The center contact 112 is connected in an electrically conducting fashion to the supply lead 108 led out of the pinched end 101 near the base, while the other, annular electric contact 113 is connected electrically, via a current feedback 115, sheathed in a ceramic tube 114, to the supply lead 109 projecting from the pinched end 102 remote from the base. Provided in the outer wall of the cylindrical base shell 110 is a groove 126, which runs in an annular fashion along the circumference of the base shell 110 and serves to fasten the annular flange 127 already mentioned above. The groove 126 has a depth of approximately 0.2 mm, and is illustrated in FIG. 2 in an enlarged fashion.

The annular flange 127 illustrated in FIG. 3 has an annular opening 128 whose diameter is large enough to permit the flange 127 to be pushed over the lamp vessels 100, 116 and current feedback 115, sheathed in the ceramic tube 114, and to be latched or snapped into the groove 126. The diameter of the annular opening 128 is therefore coordinated, in particular, with the diameter of the groove 126. The annular opening 128 of the flange 127 is defined by the free ends of four radially inwardly directed lugs 129. A cutout 130 extending the ring opening 128 is arranged between two of these lugs 129 in each case. The four cutouts 130 are placed in such a way that, after the fastening of the flange 127 in the groove 126 of the base shell 110, they are arranged in the region of the welding lugs 123 and, as a result, the ring opening 128 in the region of the welding lugs 123 is widened. The four lugs 129 exert a spring action which permits a purely mechanical fastening of the flange 127 on the base 125 by means of latching or snapping a flange 127 into the groove 126. One of the lugs 129 is provided with a stamped-out portion 131 which, after the mounting of the flange 127 on the base shell 110, engages in a web or projection (not illustrated) of the groove 126 which is coordinated therewith. The stamped-out portion 131 and the web or projection prevent rotary movements of the flange 127 in the groove 126.

The flange 127 is constructed in steps. It has a bottom surface 132 in which the annular opening 128 is arranged, and an outer edge surface 133 offset therefrom by a step 134. After the mounting of the high-pressure discharge lamp in the motor vehicle headlight, the step 134 engages in the lamp holder. The edge defined by the step 134 is therefore appropriately adapted to the lamp holder. After the mounting of the high-pressure discharge lamp in the motor vehicle headlight, the edge surface 133 of the flange 127 bears against the back wall of the headlight reflector. Integrally formed on the edge surface 133 of the annular flange 127 are three radially outwardly directed reference noses 135–137 which, after the mounting of the lamp in the motor vehicle headlight, engage in corresponding cutouts in the lamp holder. The reference nose 137 is constructed to be wider than the two other reference noses 135, 136, in order to fix the mounting position of the high pressure discharge lamp in the lamp holder of the motor vehicle headlight, and, in particular, in order to ensure that the high-pressure discharge lamp can be inserted into the lamp holder of the motor vehicle headlight only in such a way that the ceramic tube 114 is arranged below the outer bulb 116. The annular opening 128 is placed with reference to the reference noses 135–137 and the step 134 in such a way that after the high pressure discharge lamp has been mounted in the headlight its longitudinal axis is arranged below the optical axis of the headlight reflector displaced by 0.5 mm in a parallel fashion, in order to take account of the convection-induced upward curve of the discharge arc.

Figure 4:
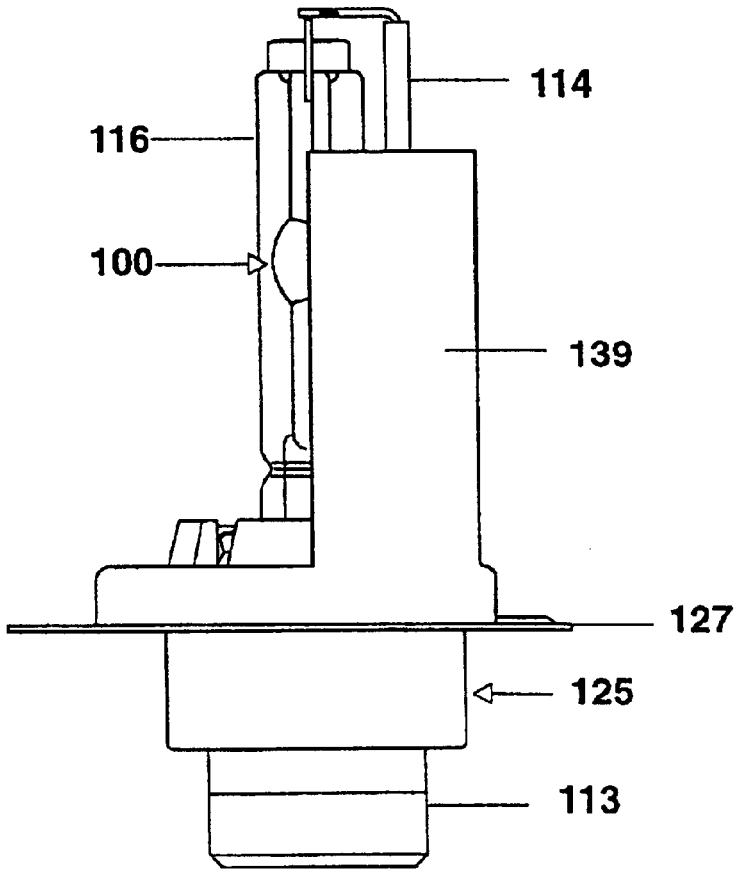
FIG. 4 shows a side view of a second exemplary embodiment of the high-pressure discharge lamp according to the invention.

The configuration and the dimensions of the annular flange 127 are coordinated with the shape and the corresponding dimensions of an H4 lamp holder. As a result, the high-pressure discharge lamp can be inserted into a motor vehicle headlight which has a holder for an H4 halogen incandescent lamp. In order to influence the light distribution, the outer bulb 116 is partially provided with a light-shielding coating 138. A high-pressure discharge lamp in accordance with the second exemplary embodiment of the invention is illustrated in FIG. 4. The high-pressure discharge lamp in accordance with the second exemplary embodiment differs from the first exemplary embodiment only in that instead of the light-shielding coating 138 the high-pressure discharge lamp has a light-shielding, cambered metal sheet 139 which partially surrounds the lamp vessels 100, 116 and is constructed in one piece with the annular flange 127. The metal sheet 139 and the flange 127 are produced with the aid of a deep-drawing process. The high-pressure discharge lamps of the first and second exemplary embodiments are identical in all other details. The same reference numerals are therefore used in FIGS. 1 and 4 for identical parts.

The invention is not limited to the two exemplary embodiments explained in more detail above. It is also possible, for example, to adapt the configuration and the dimensions of the annular flange 127 to the shape and dimensions of the lamp holder of a motor vehicle headlight for H7, H9 or H11 halogen incandescent lamps. The features essential to the invention, in particular the configuration of the snap or latching connection between the base and the annular flange are not affected by such an adaptation. However, a high-pressure discharge lamp provided with an annular flange, coordinated with an H7, H9 or H11 lamp holder requires other light-shielding means than the high-pressure discharge lamps in accordance with the first and second exemplary embodiments. In the case of a high-pressure discharge lamp which is inserted into the motor vehicle headlight instead of an H7, H9 or H11 halogen incandescent lamp, it suffices to provide the outer bulb 116 with a light-shielding coating in the region of the end 102 of the discharge vessel 100 remote from the base. However, it is also possible to dispense completely with light-shielding coatings in the case of such a high-pressure discharge lamp.

Moreover, the invention can also be applied to high-pressure discharge lamps which have a starting device or operating circuit integrated in the base, as is disclosed, for example, in German Patent Application DE 199 13 942.

What is claimed is:

1. A high-pressure discharge lamp for motor vehicle headlights, having at least one transparent lamp vessel (100) and means for generating a light-emitting gas discharge, as well as a base (125) which is provided with electric terminals (112, 113) and in which the at least one transparent lamp vessel (100) is fixed, the base being provided with an annular flange (127) having a generally annular opening (128) for the purpose of mounting the high-pressure discharge lamp in a holder of a motor vehicle headlight, characterized in that the annular flange (127) is adapted to holders of motor vehicle headlights for halogen incandescent lamps and is fixed on the base (125) by means of a snap or latching connection characterized in that the base (125) consists of an electrically insulating material, and characterized in that a metal fastening means (123) for holding and/or adjusting the at least one lamp vessel (100) is provided in the base (125), and in the region of the metal fastening means (123) the annular flange (127) has cutouts (130) which extend the annular opening (128) of the annular flange (127).

2. The high-pressure discharge lamp as claimed in claim 1 characterized in that the high-pressure discharge lamp has a means for shielding light (138, 139).

3. The high-pressure discharge lamp as claimed in claim 2, characterized in that the means for shielding light is constructed as a metal sheet (139) which partially surrounds the at least one lamp vessel (100).

4. The high-pressure discharge lamp as claimed in claim 3, characterized in that the metal sheet (139) is fastened on the annular flange (127), or is constructed in one piece with the annular flange (127).

5. A high-pressure discharge lamp for motor vehicle headlights, having at least one transparent lamp vessel (100) and means for generating a light-emitting gas discharge, as well as a base (125) which is provided with electric terminals (112, 113) and in which the at least one transparent lamp vessel (100) is fixed, the base being provided with an annular flange (127) having a generally annular opening (128) for the purpose of mounting the high-pressure discharge lamp in a holder of a motor vehicle headlight, characterized in that the annular flange (127) is adapted to holders of motor vehicle headlights for halogen incandescent lamps and is fixed on the base (125) by means of a snap or latching connection, and characterized in that in that the annular flange (127) consists of metal and a metal fastening means (123) for holding and/or adjusting the at least one lamp vessel (100) is provided in the base (125), and in the region of the metal fastening means (123) the annular flange (127) has cutouts (130) which extend the annular opening (128) of the annular flange (127).

* * * * *